US010883361B2

(12) United States Patent
Ahmadi Kalateh Ahmad et al.

(10) Patent No.: US 10,883,361 B2
(45) Date of Patent: Jan. 5, 2021

(54) MODULAR ELECTROMAGNETIC RANGING SYSTEM FOR DETERMINING LOCATION OF A TARGET WELL

(71) Applicant: Halliburton Energy Services, Inc., Houston, TX (US)

(72) Inventors: Akram Ahmadi Kalateh Ahmad, Bedford, MA (US); Ilker R. Capoglu, Houston, TX (US); Burkay Donderici, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 164 days.

(21) Appl. No.: 15/738,407

(22) PCT Filed: Oct. 6, 2016

(86) PCT No.: PCT/US2016/055691
§ 371 (c)(1),
(2) Date: Dec. 20, 2017

(87) PCT Pub. No.: WO2018/067154
PCT Pub. Date: Apr. 12, 2018

(65) Prior Publication Data
US 2020/0088025 A1 Mar. 19, 2020

(51) Int. Cl.
*E21B 47/0228* (2012.01)
*E21B 47/024* (2006.01)
*E21B 47/092* (2012.01)

(52) U.S. Cl.
CPC ..... *E21B 47/0228* (2020.05); *E21B 47/024* (2013.01); *E21B 47/092* (2020.05)

(58) Field of Classification Search
CPC ..... E21B 47/02216; E21B 47/0905; E21B 47/024
(Continued)

(56) References Cited

U.S. PATENT DOCUMENTS 3,890,563 A * 6/1975 Dowling ..... G01V 3/28 324/340
4,372,398 A * 2/1983 Kuckes ..... G01V 3/26 175/45
(Continued)

FOREIGN PATENT DOCUMENTS

WO 2013071223 5/2013
WO 2014089402 6/2014
(Continued)

OTHER PUBLICATIONS

International Search Report and Written Opinion for Application No. PCT/US2016/055691 dated Jun. 19, 2017.
(Continued)

*Primary Examiner* — Christopher P McAndrew
(74) *Attorney, Agent, or Firm* — Scott Richardson; C. Tumey Law Group PLLC

(57) ABSTRACT

An electromagnetic ranging system and method for location a target well. The electromagnetic ranging system may comprise a modular electromagnetic ranging tool. The electromagnetic ranging tool may comprise at least one transmitter coil and a receiver coil operable to measure at least one component of the electromagnetic field. An information handling system may be in signal communication with the modular electromagnetic ranging tool. A method for electromagnetic ranging of a target wellbore may comprise disposing a modular electromagnetic ranging tool in a wellbore, transmitting an electromagnetic field to the target wellbore from at least one transmitter coil disposed on the modular electromagnetic ranging tool, measuring at least one component of a secondary electromagnetic field, and determining a relative location of the target wellbore from at least measurements by the at least one receiver coil and one or more parameters of the at least one transmitter coil.

25 Claims, 9 Drawing Sheets

(58) Field of Classification Search
USPC ..... 324/346
See application file for complete search history.

(56) References Cited

U.S. PATENT DOCUMENTS

| | | | | |
|---|---|---|---|---|
| 8,222,902 | B2 * | 7/2012 | Bittar | E21B 47/026 324/338 |
| 8,237,443 | B2 * | 8/2012 | Hopmann | E21B 47/092 324/325 |
| 8,680,866 | B2 * | 3/2014 | Marsala | G01V 3/20 324/338 |
| 8,749,243 | B2 * | 6/2014 | Bittar | E21B 47/0228 324/346 |
| 9,568,633 | B2 | 2/2017 | Goodman et al. | |
| 9,664,028 | B2 * | 5/2017 | Donderici | E21B 47/125 |
| 9,690,004 | B2 | 6/2017 | Donderici | |
| 9,709,693 | B2 | 7/2017 | Ahmad et al. | |
| 2002/0171560 | A1 * | 11/2002 | Ciglenec | E21B 29/06 340/853.1 |
| 2005/0168225 | A1 | 8/2005 | Haber et al. | |
| 2007/0278008 | A1 | 12/2007 | Kuckes et al. | |
| 2009/0166035 | A1 * | 7/2009 | Almaguer | E21B 43/11 166/254.1 |
| 2009/0192713 | A1 * | 7/2009 | Fang | G01V 3/28 702/7 |
| 2009/0302851 | A1 * | 12/2009 | Bittar | G01V 3/28 324/338 |
| 2009/0308657 | A1 * | 12/2009 | Clark | E21B 47/0228 175/45 |
| 2010/0044035 | A1 | 2/2010 | Bespalov | |
| 2011/0204896 | A1 * | 8/2011 | Zhang | E21B 47/092 324/333 |
| 2011/0308794 | A1 * | 12/2011 | Bittar | E21B 47/0228 166/254.2 |
| 2011/0309836 | A1 * | 12/2011 | Bittar | G01V 3/26 324/339 |
| 2012/0013339 | A1 * | 1/2012 | Kuckes | E21B 47/0228 324/346 |
| 2012/0139543 | A1 * | 6/2012 | McElhinney | E21B 47/0228 324/346 |
| 2012/0179378 | A1 * | 7/2012 | Duncan | E21B 47/135 702/8 |
| 2013/0056272 | A1 * | 3/2013 | Kuckes | E21B 47/024 175/45 |
| 2013/0068526 | A1 * | 3/2013 | Snyder | E21B 47/0228 175/40 |
| 2013/0184995 | A1 * | 7/2013 | Sinclair | G01V 99/00 702/9 |
| 2014/0191879 | A1 * | 7/2014 | Bittar | E21B 43/2406 340/854.1 |
| 2015/0075276 | A1 * | 3/2015 | Cooper | E21B 47/135 73/152.58 |
| 2015/0268371 | A1 | 9/2015 | Donderici et al. | |
| 2016/0070018 | A1 * | 3/2016 | Nichols | G01V 3/28 324/339 |
| 2016/0194948 | A1 * | 7/2016 | Donderici | E21B 47/092 324/338 |
| 2016/0216396 | A1 | 7/2016 | Golla et al. | |
| 2016/0258288 | A1 * | 9/2016 | Hay | E21B 7/06 |
| 2016/0265343 | A1 | 9/2016 | Donderici | |
| 2016/0273344 | A1 | 9/2016 | Wu et al. | |
| 2017/0138132 | A1 | 5/2017 | Wilson et al. | |
| 2017/0254918 | A1 | 9/2017 | Donderici | |
| 2019/0055837 | A1 * | 2/2019 | San Martin | E21B 47/092 |
| 2019/0218905 | A1 * | 7/2019 | Donderici | E21B 47/0228 |

FOREIGN PATENT DOCUMENTS

| | | |
|---|---|---|
| WO | 2015047865 | 2/2015 |
| WO | 2015047953 | 2/2015 |
| WO | 2018056999 | 3/2018 |
| WO | 2018063169 | 4/2018 |

OTHER PUBLICATIONS

"New Logging While Drilling Ranging Technique for SAGD: Theory and Experiment", M. Bittar, H. Wu and S. Li, SPE, Oct. 2012. SPE 159405.

"An Electromagnetic Survey Method for Directionally Drilling a Relief Well into a Blown Out Oil or Gas Well", A.F. Kuckes, T. Lautzenhiser, A. G. Nekut and R. Sigal, SPE, Jun. 1984. SPE 10946-PA.

European Search report for Application No. 16918435.5, dated Jul. 17, 2019.

* cited by examiner

MODULAR ELECTROMAGNETIC RANGING SYSTEM FOR DETERMINING LOCATION OF A TARGET WELL

BACKGROUND

The present disclosure relates to systems and methods for electromagnetic ranging. Specifically, a modular electromagnetic ranging system may be disclosed determining the position and direction of a target wellbore using a modular electromagnetic ranging tool.

Wellbores drilled into subterranean formations may enable recovery of desirable fluids (e.g., hydrocarbons) using a number of different techniques. Knowing the location of a target wellbore may be important while drilling a second wellbore. For example, in the case of a target wellbore that may be blown out, the target wellbore may need to be intersected precisely by the second (or relief) wellbore in order to stop the blow out. Another application may be where a second wellbore may need to be drilled parallel to the target wellbore, for example, in a steam-assisted gravity drainage ("SAGD") application, wherein the second wellbore may be an injection wellbore while the target wellbore may be a production wellbore. Yet another application may be where knowledge of the target wellbore's location may be needed to avoid collision during drilling of the second wellbore.

Electromagnetic ranging is one technique that may be employed in subterranean operations to determine direction and distance between two wellbores. Devices and methods of electromagnetic ranging may be used to determine the position and direction of a target well by an electromagnetic transmitter and a pair of sensors in a logging device and/or drilling device while part of a bottom hole assembly in the second wellbore. Additional electromagnetic ranging methods may energize a target well by a current source on the surface and measure the electromagnetic field produced by the target well on a logging and/or drilling device in the second wellbore, which may be disposed on a bottom hole assembly. However, this method may be problematic as it requires access to the target well. Methods in which energizing may occur from the first wellbore without access to the target wellbore may be used but may be limited due to current transmitter and receiver configurations.

BRIEF DESCRIPTION OF THE DRAWINGS

These drawings illustrate certain aspects of some of the examples of the present invention, and should not be used to limit or define the invention.

DETAILED DESCRIPTION

The present disclosure relates generally to a system and method for electromagnetic ranging. More particularly, a system and method for determining the position and direction of a target well using a modular electromagnetic ranging tool. The disclosure describes a system and method for electromagnetic ranging that may be used to determine the position and direction of a target well by an electromagnetic transmitter and a pair of sensors in a modular electromagnetic ranging tool. Electromagnetic ranging tools may comprise a tubular assembly of modular sections, which may comprise a transmitter coil and/or receivers. Transmission of electromagnetic fields by the transmitter coil and recording of signals by the receivers may be controlled by an information handling system.

Certain examples of the present disclosure may be implemented at least in part with an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Figure 1:
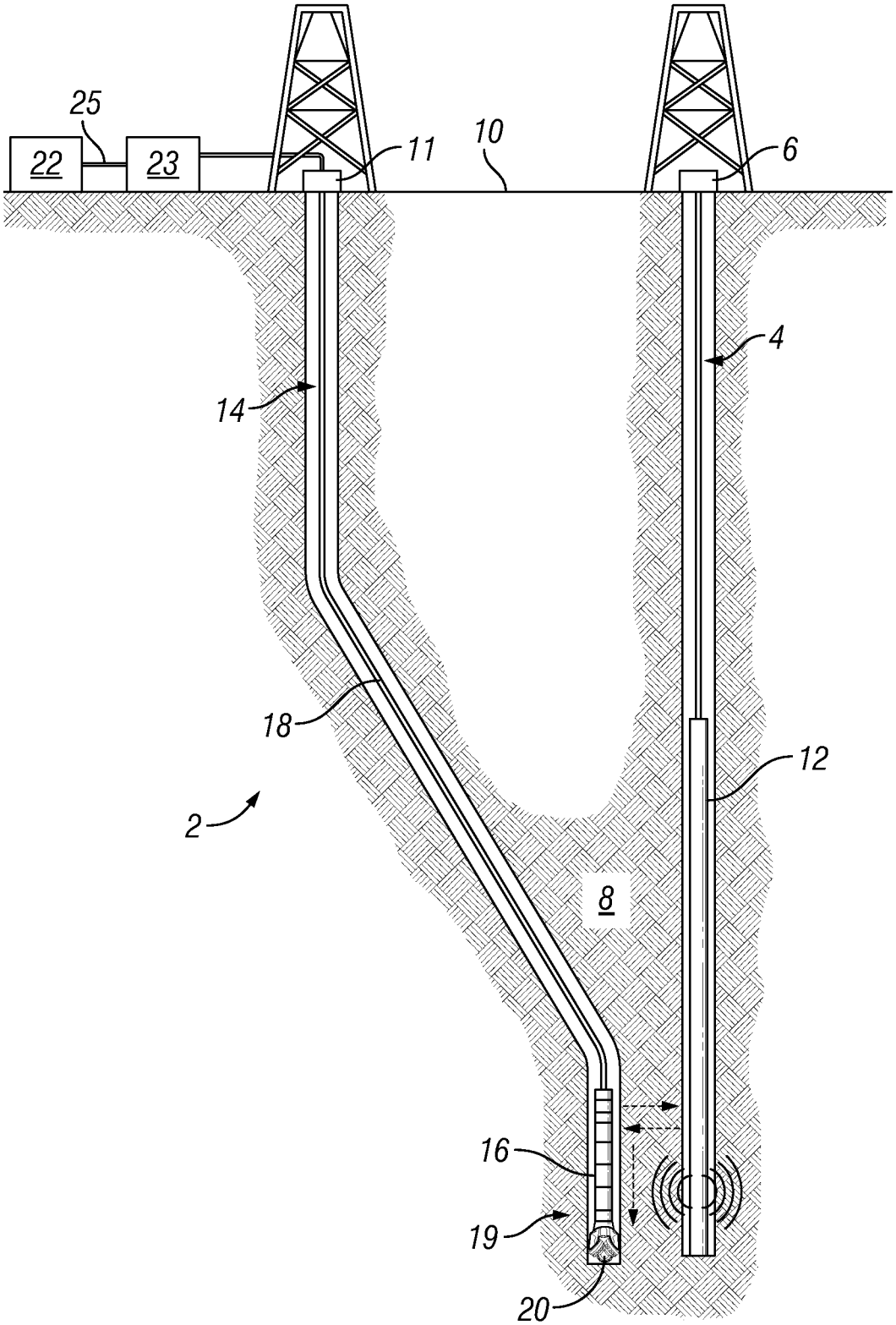
FIG. 1 is an example of an electromagnetic ranging system.

FIG. 1 illustrates an electromagnetic ranging system 2. As illustrated, a target wellbore 4 may extend from a first wellhead 6 into a subterranean formation 8 from a surface 10. While target wellbore 4 is shown as being generally vertical in nature, it should be understood that target wellbore may include horizontal, vertical, slanted, curved, and other types of wellbore geometries and orientations. Target wellbore 4 may be cased or uncased. A conductive member 12 may be disposed within target wellbore 4 and may comprise a metallic material that may be conductive. By way of example, conductive member 12 may be a casing, liner, tubing, or other elongated metal tubular disposed in target wellbore 4. Determining the location, including position and direction, of conductive member 12 accurately and efficiently may be useful in a variety of applications. For example, target wellbore 4 may be a "blowout" well. Target wellbore 4 may need to be intersected precisely by a second wellbore 14 in order to stop the "blowout." In examples, second wellbore 14 may be used in applications when drilling a second wellbore 14 parallel to an existing target wellbore 4, for example, in SAGD applications. Additionally, electromagnetic ranging system 2 may be used in second wellbore 14 to detect target wellbore 4, and/or additional wells, during drilling operations to avoid collision. In examples, nearby target wellbore 4 may not be accessible and/or any information about nearby positions and/or structure of target wellbore 4 may not be available. As detailed below, modular electromagnetic ranging tool 16 may be used to determine the range to target wellbore 4.

With continued reference to FIG. 1, second wellbore 14 may also extend from a second wellhead 11 that extends into subterranean formation 8 from surface 10. Generally, second wellbore 14 may include horizontal, vertical, slanted, curved, and other types of wellbore geometries and orientations. Additionally, while target wellbore 4 and second wellbore 14 are illustrated as being land-based, it should be understood that the present techniques may also be applicable in offshore applications. Second wellbore 14 may be cased or uncased. In examples, a drill string 18 may begin at second wellhead 11 and traverse second wellbore 14. A drill bit 20 may be attached to a distal end of drill string 18 and may be driven, for example, either by a downhole motor and/or via rotation of drill string 18 from surface 10. Drill bit 18 may be a part of bottom hole assembly 19 at distal end of drill string 18. As illustrated, bottom hole assembly 19 may comprise modular electromagnetic ranging tool 16 and drill bit 18 coupled to a distal end of modular electromagnetic ranging tool 16. While not illustrated, bottom hole assembly 19 may further comprise one or more of a mud motor, power module, steering module, telemetry subassembly, and/or other sensors and instrumentation as will be appreciated by those of ordinary skill in the art. As will be appreciated by those of ordinary skill in the art, bottom hole assembly 19 may be a measurement-while drilling or logging-while-drilling system.

The electromagnetic ranging system 2 may comprise a modular electromagnetic ranging tool 16. Modular electromagnetic ranging tool 16 may be a part of bottom hole assembly 19 and may comprise at least one module and/or at least one subassembly. In examples, components of the modular electromagnetic ranging tool 16 and/or electromagnetic ranging system 2 may be disposed on a module and/or sub assembly, wherein a module and/or sub assembly may be the same. Additionally, components may be individually disposed on a module and/or sub assembly. Modular electromagnetic ranging tool 16 may be used for determine the distance and direction to target wellbore 4. Additionally, modular electromagnetic ranging tool 16 may be connected to and/or controlled by information handling system 22, which may be disposed on surface 10. In examples, information handling system 22 may be in signal communication with modular electromagnetic ranging tool 16, where information handling system 22 may communicate with modular electromagnetic ranging tool 16 through a communication line (not illustrated) disposed in (or on) drill string 18. In examples, wireless communication may be used to transmit information back and forth between information handling system 22 and modular electromagnetic ranging tool 16. Information handling system 22 may transmit information to modular electromagnetic ranging tool 16 and may receive as well as process information recorded by modular electromagnetic ranging tool 16. Modular electromagnetic ranging tool 16 may also include components, such as a microprocessor, memory, amplifier, analog-to-digital converter, input/output devices, interfaces, or the like, for receiving and processing signals received by the modular electromagnetic ranging tool 16 and then transmitting the processed signals to surface 10. Alternatively, raw measurements from modular electromagnetic ranging tool 16 may be transmitted to surface 10.

Any suitable technique may be used for transmitting signals from modular electromagnetic ranging tool 16 to surface 10, including, but not limited to, mud-pulse telemetry, acoustic telemetry, and electromagnetic telemetry. While not illustrated, bottom hole assembly 19 may include a telemetry subassembly that may transmit telemetry data to surface 10. In one or more embodiments, a transmitter in the telemetry subassembly may be operable to generate pressure pulses in the drilling fluid that propagate along the fluid stream to surface 10. At surface 10, pressure transducers (not shown) may convert the pressure signal into electrical signals for a digitizer 23. Digitizer 23 may supply a digital form of the telemetry signals to an information handling system 22 via a communication link 25, which may be a wired or wireless link. The telemetry data may be analyzed and processed by information handling system 22. For example, the telemetry data could be processed to location of target wellbore 4. With the location of target wellbore 4, a driller could control the bottom hole assembly 19 while drilling second wellbore 14 to intentionally intersect target wellbore 4, avoid target wellbore 4, and/or drill second wellbore 14 in a path parallel to target wellbore 4.

Figure 2:
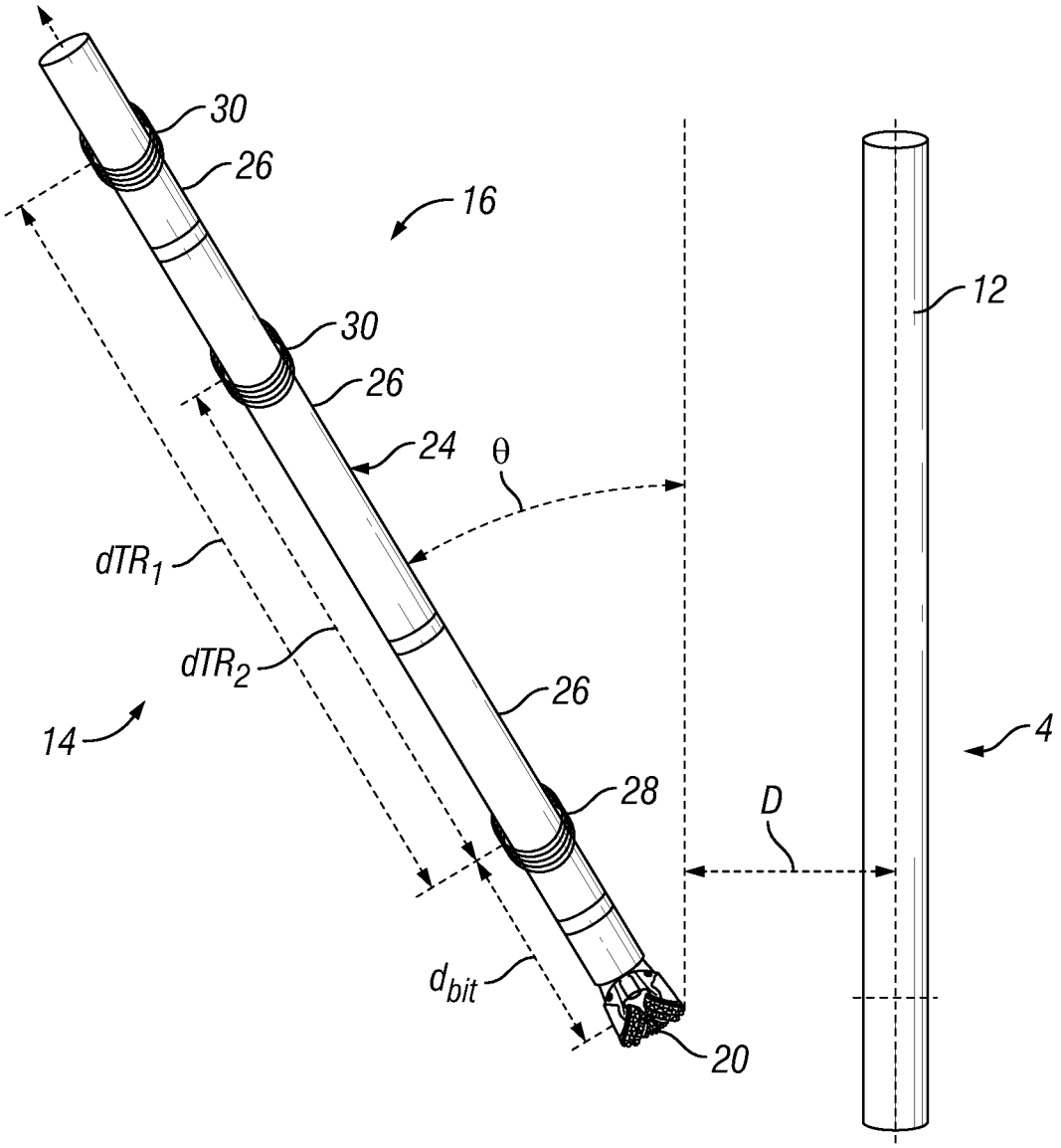
FIG. 2 is an example of bottom hole assembly moving toward a target well.

Turning now to FIG. 2, modular electromagnetic ranging tool 16 is illustrated in more detail. Modular electromagnetic ranging tool 16 may be used to determined location of target wellbore 4, including direction and distance to target wellbore 4. Direction to target wellbore 4 may be represented by the inclination angle θ of modular electromagnetic ranging tool 16 with respect to target wellbore 4. Distance to target wellbore 4 may be represented by the distance D from drill bit 20 to target wellbore 4. As illustrated, modular electromagnetic ranging tool 16 may be used in determining location of target wellbore 4, including distance D and inclination angle θ. Conductive member 12 may be disposed in target wellbore 4. Modular electromagnetic ranging tool 16 may comprise a tubular assembly 24 of modular sections 26. Drill bit 20 is shown at a distal end of tubular assembly 24. Each of the modular sections 26 may comprise pipe and/or other suitable well conduit. The modular sections 26 may be any suitable length, including from about ten feet to about fifty feet, from about fifteen feet to about forty feet, or about twenty-five feet to about thirty-five feet. Any suitable technique may be used for coupling of the modular sections 26 to one another to form tubular assembly 24, including threaded connections or collars, among others.

Without limitation, modular electromagnetic ranging tool 16 may comprise a transmitter coil 28 and receivers 30. The distance from transmitter coil 28 to each of the receivers 30 is denoted by $dTR_1$ and dTR2, respectively. The distance between drill bit 20 and the closest component, whether transmitter coil 28 or one of the receivers 30, denoted by bit. In examples, modular electromagnetic ranging tool 16 may comprise a plurality of transmitter coils 28 and/or a plurality of receivers 30. Without limitation, transmitter coils 28 may be any suitable type of coil transmitter, such as tilted coils. The proper arrangement of transmitter coil 28 and/or receivers 30 may provide appropriate signal differences between a received signal at receivers 30. The received signal may need a high enough signal ratio between the signals scattered from target wellbore 4 to the signal directly created by transmitter coil 28. While the receivers on FIG. 2 are illustrated as coils, it is noted here that the concepts that are described herein are valid for any type of receiver antenna other than coils. As an example, receivers 30 may include receiver coils (e.g., tilted receiver coils), magnetometer receivers, wire antenna, toroidal antenna or azimuthal button electrodes.

As will be appreciated, the modular electromagnetic ranging tool 16 may be run in subterranean formations 8 with different formation properties. As such, the modular electromagnetic ranging tool 16 may be optimized for different formation properties, including different operating frequencies and different transmitter-receiver spacing $dTR_1$, $dTR_2$ for the different operating frequencies. By way of example, the electromagnetic ranging tool may operate at different frequencies making use of a receiver configuration that may be most suitable for formation resistivity. This may be done by placing multiple receivers 30 on the modular electromagnetic ranging tool 16. Each of the receivers 30 may be operable at a different frequency. The frequency may be optimized based on the transmitter-receiver spacing $dTR_1$, $dTR_2$. While transmitter-receiver spacing $dTR_1$, $dTR_2$ may vary based on a number of factors, $dTR_1$ may range from about five feet to about one hundred fifty feet, from about twenty five feet to about one hundred feet, or from about seventy five feet to about one hundred feet. Additionally, $dTR_2$ may range from about five feet to about one hundred feet, about ten feet to about fifty feet, about ten feet to about twenty five feet, about thirty feet to about fifty feet, or about fifty feet to about seventy five feet. In some examples, $dTR_1$ may range from about eighty six feet to about ninety six feet, and $dTR_2$ may range from about fourteen feet to about twenty four feet, thirty two feet to about forty two feet, or about fifty nine feet to about sixty nine feet. These transmitter-receiver spacings $dTR_1$, $dTR_2$ may be used at a variety of different frequencies, including from 0.5 to about 5 kilohertz, from about 1 to about 10 kilohertz, or from about 50 kilohertz to about 100 kilohertz. It should be understood that frequencies and transmitter-receiver spacings $dTR_1$, $dTR_2$ outside these disclosed ranges may also be suitable, depending on the application.

In examples, transmitter coil 28 may produce an electromagnetic field, which may excite current (produce eddy current) within conductive member 12 of target wellbore 4. The current within conductive member 12 may produce a secondary electromagnetic field. The magnitude of the secondary electromagnetic field may be detected by receivers 30 of modular electromagnetic ranging tool 16. Using these measurements of the secondary magnetic field, the location of target wellbore 4 may be determined. By way of example, the direction and distance of target wellbore 4 may be determined with respect to second wellbore 14. Without limitation, to determine the distance from modular electromagnetic ranging tool 16 to target wellbore 4 and/or the inclination angle to the target wellbore 4 at least two receivers 30 may be used on modular electromagnetic ranging tool 16. Receivers 30 may have a magnetic dipole in a certain direction and may only be sensitive to the component of the magnetic field in that direction. Thus, two receivers 30, tilted in different directions, may be used to capture the magnitude of the secondary electromagnetic field. Analyses of the measured secondary electromagnetic filed may provide the distance D and inclination angle θ between target wellbore 4 and modular electromagnetic ranging tool 16. The distance D and inclination angle θ are shown on FIG. 2.

Figure 3:
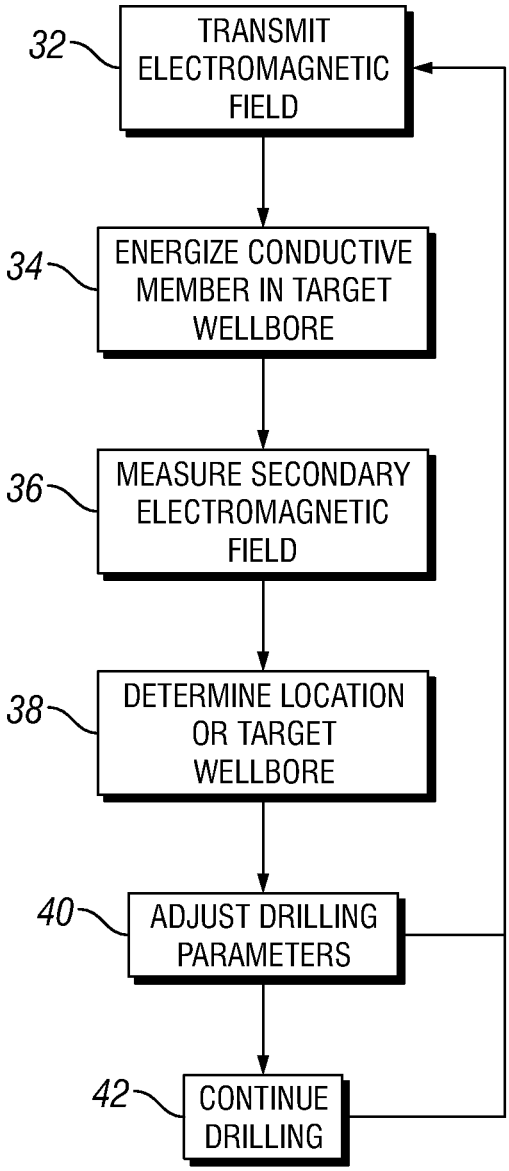
FIG. 3 is a flow chart of a process in determine the distance and direction from a bottom hole assembly to a target well.

Referring now to FIG. 3, a flow chart is provided of a method of utilizing electromagnetic ranging system 2 to determine distance D and inclination angle θ to target wellbore 4 from second wellbore 14. At box 32, an electromagnetic field may be produced and/or transmitted from transmitter coil 28 to target wellbore 4. As previously described, transmitter coil may be disposed on modular electromagnetic ranging tool 16 in second wellbore 14. As represented by box 34, target wellbore 4, which may comprise conductive member 12, may be energized by the electromagnetic field produced by transmitter coil 28. Energizing conductive member 12, within target wellbore 4, may produce an eddy current, which may in turn allow conductive member 12 to form a secondary electromagnetic field. The intensity of the secondary electromagnetic field formed by conductive member 12 may be measured by receivers 30, at block 36. The distance between each receivers 30 and/or transmitter coil 28 may be used to determine the distance and direction of target wellbore 4.

At box 38, an inversion scheme, for example, may be used to determine location of a target wellbore based on the secondary electromagnetic field measurements from receivers 30. By way of example, the distance and direction of target wellbore 4 may be determined with respect to second wellbore 14. Determination of distance and direction may be achieved by utilizing the relationships below between target wellbore 4 and the magnetic field received by receivers 30.

$$\overline{H} = \frac{I}{2\pi r}\hat{\phi} \tag{1}$$

wherein H is the magnetic field vector, I is the current on conductive member 12 in target wellbore 4, r is the shortest distance between the receivers 30 and conductive member 12, and ϕ is a vector that is perpendicular to both z axis of receivers 30 and the shortest vector that connects conductive member 12 to receivers 30. It should be noted that this simple relationship assumes constant conductive member 12 current along target wellbore 4, however, persons of ordinary skill in the art will appreciate that the concept may be extended to any current distribution by using the appropriate model. It may be clearly seen that both distance and direction can be calculated by using this relationship.

$$r = \frac{I}{2\pi|\overline{H}|} \tag{2}$$

$$\Phi = \text{angle}(\hat{x}\cdot\overline{H}, \hat{y}\cdot\overline{H}) + 90 \tag{3}$$

where • is the vector inner-product operation. It has been observed that Equation (3) may be a reliable measurement of the relative direction of target wellbore 4 with respect to receivers 30 coordinates, and it may be used as long as signal received from target wellbore 4 may be substantially large compared to measurement errors. However Equation (2) may not be reliably used to calculate distance since a direct or accurate measurement of I does not exist. Specifically, it has been observed that any analytical calculation of I may be 50% off due to unknown target wellbore 4 characteristics. Furthermore, any in-situ calibration of I may not produce a system reliable enough to be used in SAGD activities and/or wellbore intercept applications due to variations in target wellbore 4 current due to changing formation resistivity and skin depth at different sections of a wellbore. As a result, the systems of the prior art that measure absolute magnetic field values may not be suitable for steam assisted gravity drainage well operations and/or wellbore intercept applications.

In examples, magnetic field gradient measurements may be utilized, where spatial change in the magnetic field may be measured in a direction that may have a substantial component in the radial (r-axis) direction as below:

$$\frac{\partial \overline{H}}{\partial r} = -\frac{I}{2\pi r^2}\hat{\phi} \tag{4}$$

wherein ∂ is the partial derivative. With this gradient measurement available in addition to an absolute measurement, it may be possible to calculate the distance as follows:

$$r = \frac{|\overline{H}|}{\left|\frac{\partial \overline{H}}{\partial r}\right|} \tag{5}$$

As such, Equation (5) may not require knowledge of the conductive member 12 current I, if both absolute and gradient measurements are available. The direction measurement may still be made as shown in Equation (3). Thus, the inversion scheme and/or gradient measurements may be used to transform information recorded by receivers 30 into distance and direction measurements.

Distance and direction measurements may allow an operator to determine the relative location between target wellbore 4 and second wellbore 14. At box 34, an operator may adjust one or more drilling parameters of second wellbore 14 in response to the determined location of target wellbore 4. By way of example, these adjustments may be made to bottom hole assembly 19 into a direction that may come into contact with target wellbore 4. Alternatively, the adjustments may be made to guide bottom hole assembly 19 to move away from target wellbore 4 and/or move parallel to the direction of target wellbore 4. At block 42, the drilling of second wellbore 14 may be continued. Blocks 32 to 42 may be repeated to guide the drilling of second wellbore 14 as desired using modular electromagnetic ranging tool 16.

As discussed above, distance and direction to target wellbore 4 from modular electromagnetic ranging tool 16 may be determined through recorded measurements of receivers 30. Specifically, to determine distance and direction between target wellbore 4 and modular electromagnetic ranging tool 16 at least two measurements may be needed, for example, measurements from two different receivers spaced axially on modular electromagnetic ranging tool 16. Thus, axial gradient ranging may be used, which may use two or more receivers 30 disposed on modular electromagnetic ranging tool 16 at known distances along the axial direction. Using these known distances, the signals received by receivers 30 may be used to determine distance and direction. In examples, two receivers 30 may be disposed on modular electromagnetic ranging tool 16. This may allow for three different configurations that comprise two receivers 30 and a single transmitter coil 28.

Figure 4A:
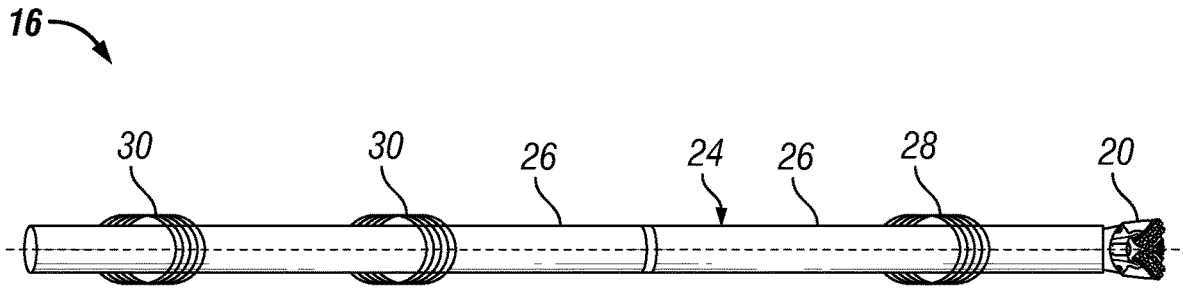
FIG. 4*a* is an example of a modular electromagnetic ranging tool.
Figure 4B:
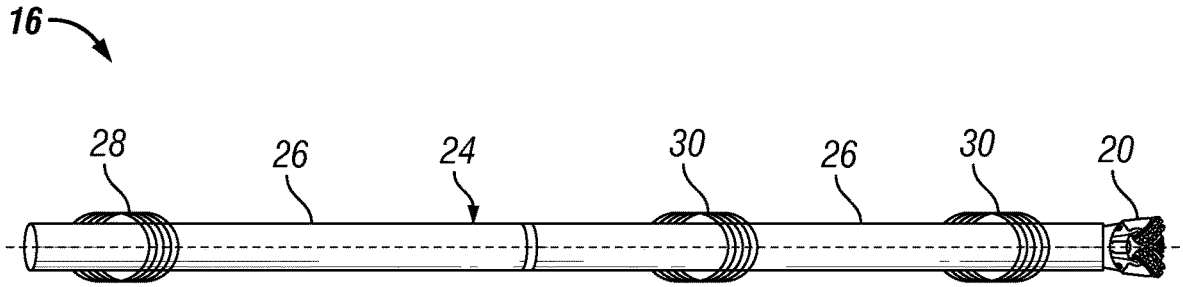
FIG. 4*b* is another example of a modular electromagnetic ranging tool.
Figure 4C:
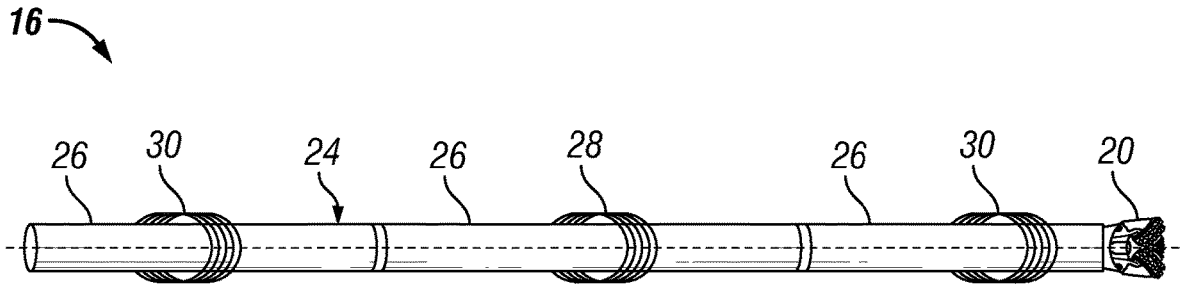
FIG. 4*c* is another example of a modular electromagnetic ranging tool.

FIGS. 4*a*-4*c* illustrate three different configurations that may be possible in which modular electromagnetic ranging tool 16 comprises two receivers 30 and a single transmitter coil 28. As illustrated, modular electromagnetic ranging tool 16 may comprise modular electromagnetic ranging tool 16, which may comprise a tubular assembly 24 of modular sections 26. Drill bit 20 is shown at a distal end of tubular assembly 24. Modular sections 26 may comprise transmitter coil 28 and/or receivers 30. Specifically, FIG. 4*a* illustrates a Surface Side Configuration in which transmitter coil 28 may be disposed close to drill bit 20 and two receivers 30 may be disposed on the side of transmitter coil 28 opposite of the side that drill bit 20 may be disposed. Additionally, receivers 30 may be closer to surface 10 than transmitter coil 28. FIG. 4*b* illustrates a Bit-Side Configuration in which two receivers 30 may be closer to drill bit 20 than transmitter coil 28. FIG. 4*c* illustrates a Bilateral Configuration in which transmitter coil 28 may be between two receivers 30.

Figure 5A:
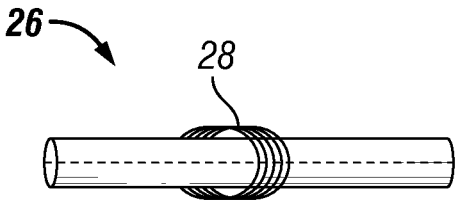
FIG. 5*a* is an example of a modular section.
Figure 5B:
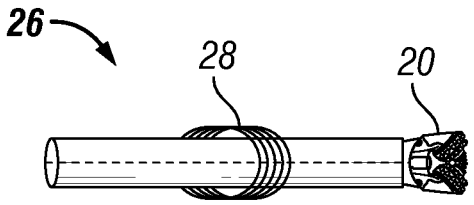
FIG. 5*b* is another example of a modular section.
Figure 5C:
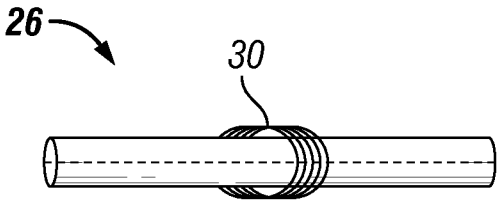
FIG. 5*c* is another example of a modular section.
Figure 5D:
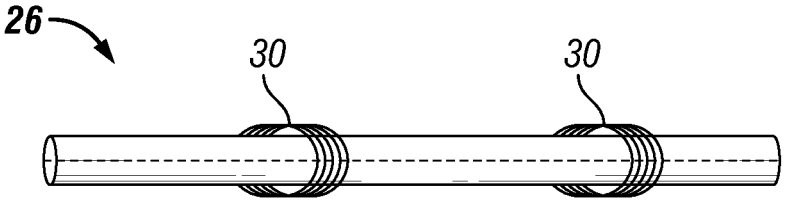
FIG. 5*d* is another example of a modular section.
Figure 5E:
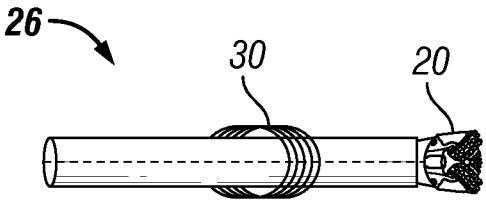
FIG. 5*e* is another example of a modular section.

In examples, transmitter coils 28 and/or receivers 30 may be disposed on modular sections 26. The modular sections 26 may be connected in different configuration and disposed within modular electromagnetic ranging tool 16. FIGS. 5*a*-5*e* illustrate modular sections 26 with different configurations that comprise transmitter coils 28 and/or receivers 30. FIG. 5*a* illustrates modular section 26 which comprises transmitter coil 28, and FIG. 5*b* illustrates modular section 26 which comprises transmitter coil 28 and drill bit 20. FIG. 5*c* illustrates modular section 26 comprising two receivers 30, and FIG. 5*d* illustrates modular section 26 comprising two receivers 30 and drill bit 20. Additionally, FIG. 5*e* illustrates modular section 26 comprising two receivers 30. It should be noted that FIGS. 5*a*-5*e* do not illustrate the entirety of configurations that may be used with modular electromagnetic ranging tool 16. In examples, there may be a plurality of transmitter coils 28 and/or receivers 30 on modular section 26, with and/or without drill bit 20. In examples, additional downhole tools (not illustrated) may be placed between modular sections 26. In one or more embodiments, a downhole tool may comprise a corrosion detection tool, a resistivity tool, a magnetometer, and/or any combination thereof. Modular sections 26 may allow operators to configure modular electromagnetic ranging tool 16 specifically to an underground environment in which second wellbore 14 may be operating within. By way of example, modular sections 26 may be selected to provide a modular electromagnetic ranging tool 16 with optimum transmitter-receiver spacing.

Figure 6:
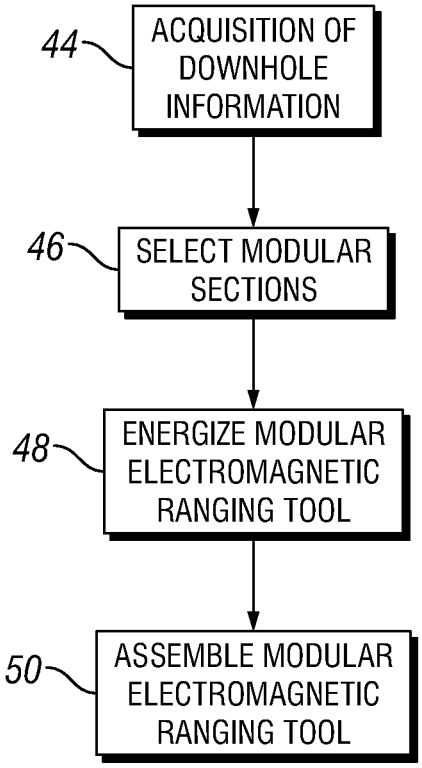
FIG. 6 is a flow chart of determining the modular sections to use on the modular electromagnetic ranging tool.

FIG. 6 illustrates a flow chart in which information may be obtained to select modular sections 26 for modular electromagnetic ranging tool 16. Determining which modular sections 26 to use in modular electromagnetic ranging tool 16 may optimize the ability of modular electromagnetic ranging tool 16 to determine the location of target wellbore 4, including distance and direction. The first step, illustrated by box 44, in selecting modular sections 26 may comprise the acquisition of downhole information, including formation resistivity, mud resistivity, and operation frequency. This information may be proprietary and/or collected as second wellbore 14 moves through subterranean formation 8. For example, formation resistivity may be determined by tools (not illustrated) which may measure the formation resistivity. Mud resistivity may be based on the particular drilling mud to be used in drilling of second wellbore 14. Additionally, based upon formation resistivity and mud resistivity, an operational frequency may be chosen that operates effectively within the collected parameters of formation resistivity and mud resistivity. This information may allow an operator to determine the combination of modular sections 26 to be used in modular electromagnetic ranging tool 16.

Selecting modular sections 26, represented by box 46, may be based on collected downhole information and the transmitter-receiver distances, as well as the distance between receivers 30. Once modular sections 26 may be selected, modular electromagnetic ranging tool 16 may be energized. Box 48 may represent the energizing of modular electromagnetic ranging tool 16, in which receivers 30 may receive signals from transmitter coils 28. In examples, the signal level recorded by receivers 30 may be used to determine the distance between individual receivers 30 and/or transmitter coil 28. Additionally, box 44 may represent additional metrics that may be used to determine the spacing between components of modular electromagnetic ranging tool 16. Metrics may comprise the signal difference between two signals of receivers 30 and the maximum absolute signal among receivers 30. Strong differences between two signals of receivers 30 may be important to reduce ambiguity and linear dependence between each of receivers 30. However, a strong absolute signal level between both receivers 30 may be important for the robustness against random additive noise. In examples, a parametric study for a wide range of spacing may be done to find an optimum structure which may have a high signal difference between two receivers 30 and/or a maximum absolute signal between two receivers 30. An additional metric that may be implemented may include a target-to-direct ratio, which may be defined as the ratio between target wellbore 4 signal and the direct signal from transmitter coil 28 to receivers 30. In examples, a target-to-direct ratio larger than 0.1 percent may be considered an acceptable margin. After determining suitable metrics for spacing between components on modular electromagnetic ranging tool 16, an appropriate configuration of modular electromagnetic ranging tool 16 may be chosen and assembled, as represented by block 50.

As explained above, to design the configuration of the system one needs to consider the level of the signal at receivers 30 and also the signal ratio between the scattering signal from target wellbore 4 to the signal coming directly from transmitter coil 28. There may be a frequency that produces the best signal ratio or absolute signal level. The biggest factor that determines this frequency may be the formation resistivity; however, other factors such as the distance (D) and the inclination angle (θ) play a smaller part. For example, target wellbore 4 may be a thin hollow metal with the following properties: $\sigma=10^6$ S/m, $\varepsilon_r=1$, $\mu_r=60$, OD=8", and ID=7". The length of target wellbore 4 may be 2000 m and tilted transmitter coil 28 may be located around the mid-point of target wellbore 4 with tilt angle of 45°. Drill bit 20 may be located at a distance D from target wellbore 4, referring to FIG. 2. Additionally, transmitter coils 28 and receivers 30 may have a diameter of about 6.75" and have on 120 turns. Transmitter coil 28 may carry current I=1A. Transmitter coil 28 and/or receiver 30, whichever may be closer to drill bit 20 may be 10 m from drill bit 20. The formation may be assumed to be homogeneous with resistivity of $R_f$ and $\varepsilon_{fr}=\mu_{fr}=1$. Considering there may be one tilted receiver 30 at distance dTR form the transmitter with tilt angle of 45° with the same characteristics of transmitter coil 28.

Figure 7A:
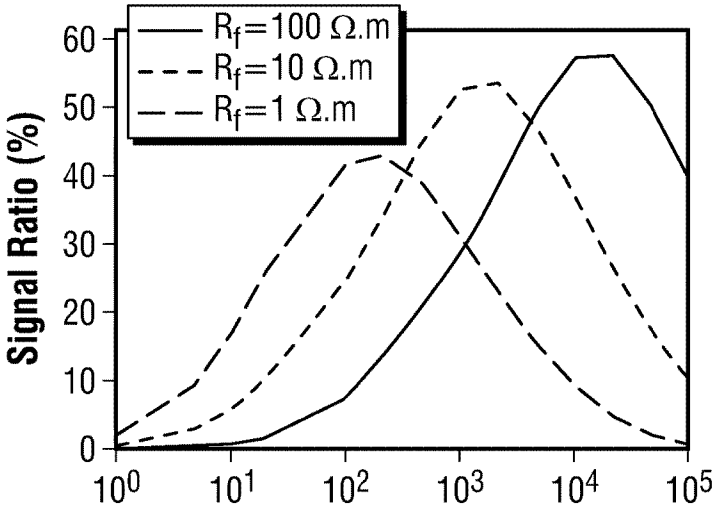
FIGS. 7*a* to 7*c* are graphs of a signal study for different formation resistivities.
Figure 7B:
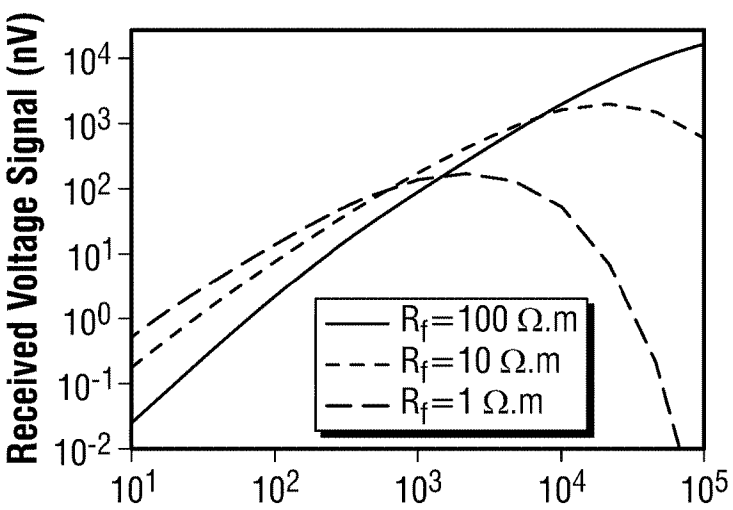
Figure 7C:
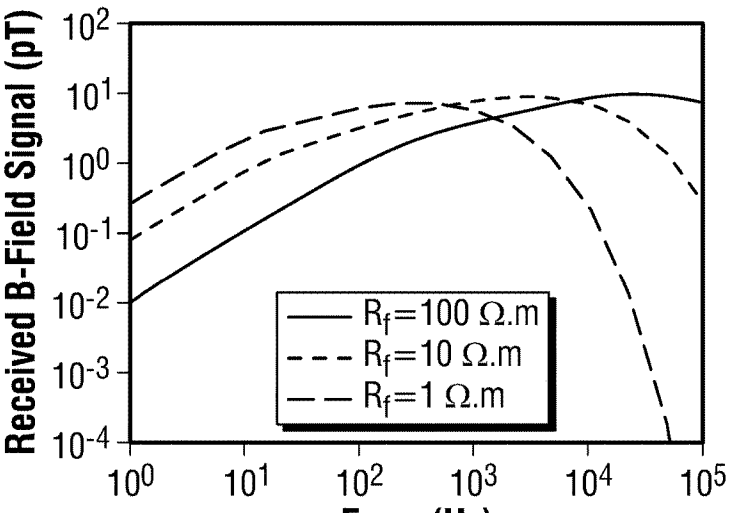

In FIGS. 7*a*-7*c*, the graphs illustrate the target-to-direct signal ratio, $$T/D(\%) = \frac{B_{total} - B_{direct}}{B_{direct}} \times 100,$$

the received voltage signal level $|V_{total}-V_{direct}|$, and the received B-field signal level $|B_{total}-B_{direct}|$ is shown for different formation resistivities over a range of frequency of 1 Hz to 100 kHz. Transmitter coil 28 and receiver 30 spacing is dTR=100 ft, inclination angle is θ=0°, and ranging distance to the target well is D=10 m. As illustrated, there is a frequency at which the signal ratio is the largest, and a nearby frequency at which the target-well signal $|V_{total}-V_{direct}|$ is maximum. For a formation resistivity of $R_f=10$ Ω·m, optimum frequencies are between 1 kHz and 10 kHz. The increase in the transmitted/received signal at low frequencies is compensated by the decrease in the signal due to the skin effect at higher frequencies.

Figure 8A:
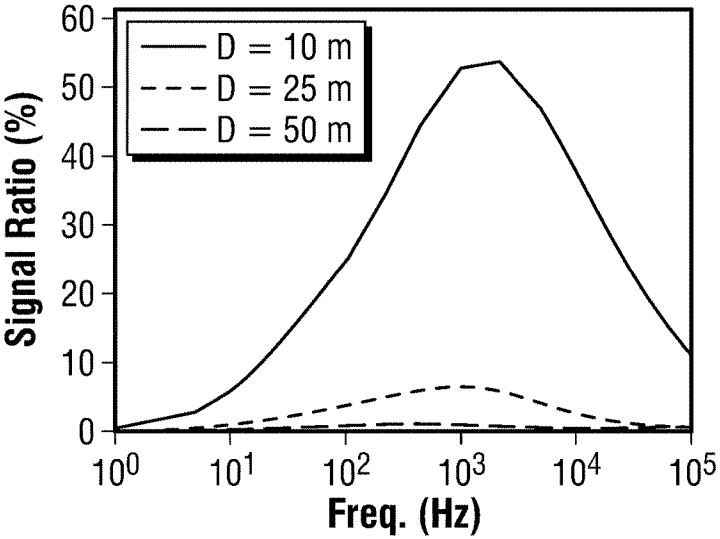
FIGS. 8*a* to 8*c* are graphs of a signal study for different ranging distances over a range of frequencies.
Figure 8B:
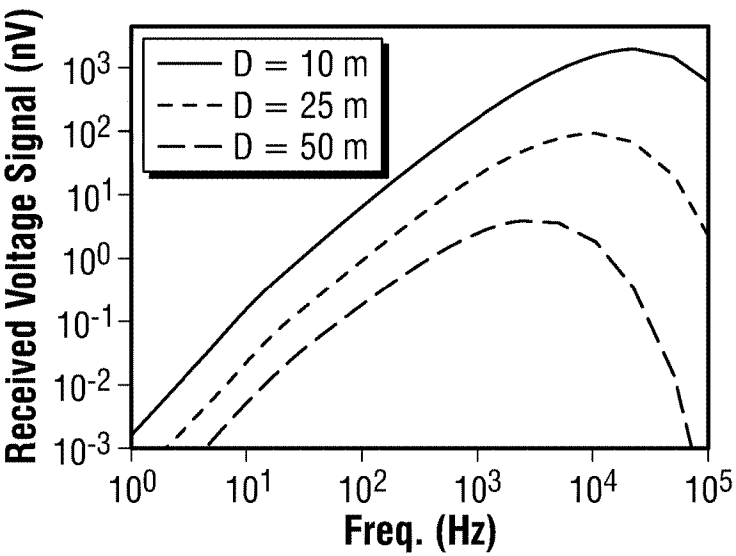
Figure 8C:
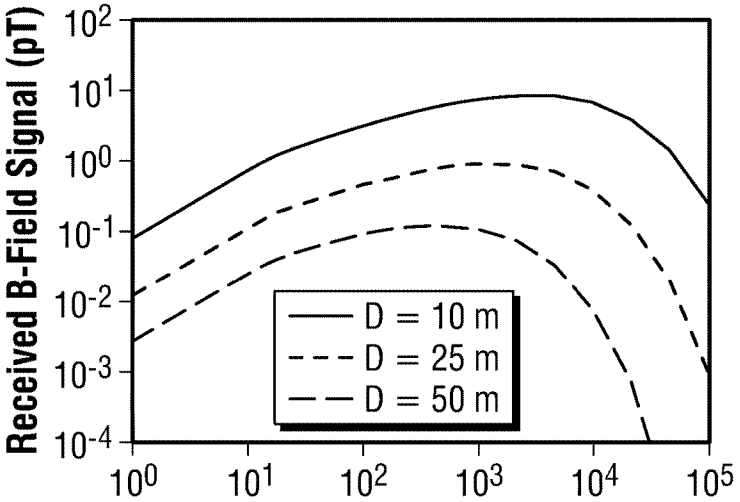

Referring now to FIGS. 8*a*-8*c*, the graphs illustrate the signal ratio and signal level for different distances to target wellbore 4. For these graphs, $R_f=10$ Ω·m and inclination angle is θ=0°. As seen, a small dependency of optimum frequency to the ranging distance is observed. Running the ranging tool at different formation properties needs applying different operation frequency and different optimized dTR spacing will be achieved for operation in different operation frequency. One could envision a multi-frequency tool that may make use of receiver 30 configuration that may be most suitable for the formation resistivity. This may be done by placing multiple receivers 30 on modular electromagnetic ranging tool 16. Parameters of frequency, such as phase difference and/or amplitude ratio, may be calculated from recorded frequencies to determine the relative location of conductive member 12.

For an example, in a T-R-R configuration, referring to FIG. 4*a*, one may design the configuration including a transmitter coil 28 and two receivers 30 and optimize the spacing for different formation resistivity based on the method described in this disclosure and come up to the design for different $R_f$ as described below:

For $R_f=1$ Ω·m⇒f=0.5~5 kHz, $dTR_1$=86'~96', $dTR_2$=14'~24'

For $R_f=1$ Ω·m⇒f=1~10 kHz, $dTR_1$=86'~96', $dTR_2$=32'~42'

For $R_f=1$ Ω·m⇒f=50~100 kHz, $dTR_1$=86'~96', $dTR_2$=59'~69'

Figure 9:
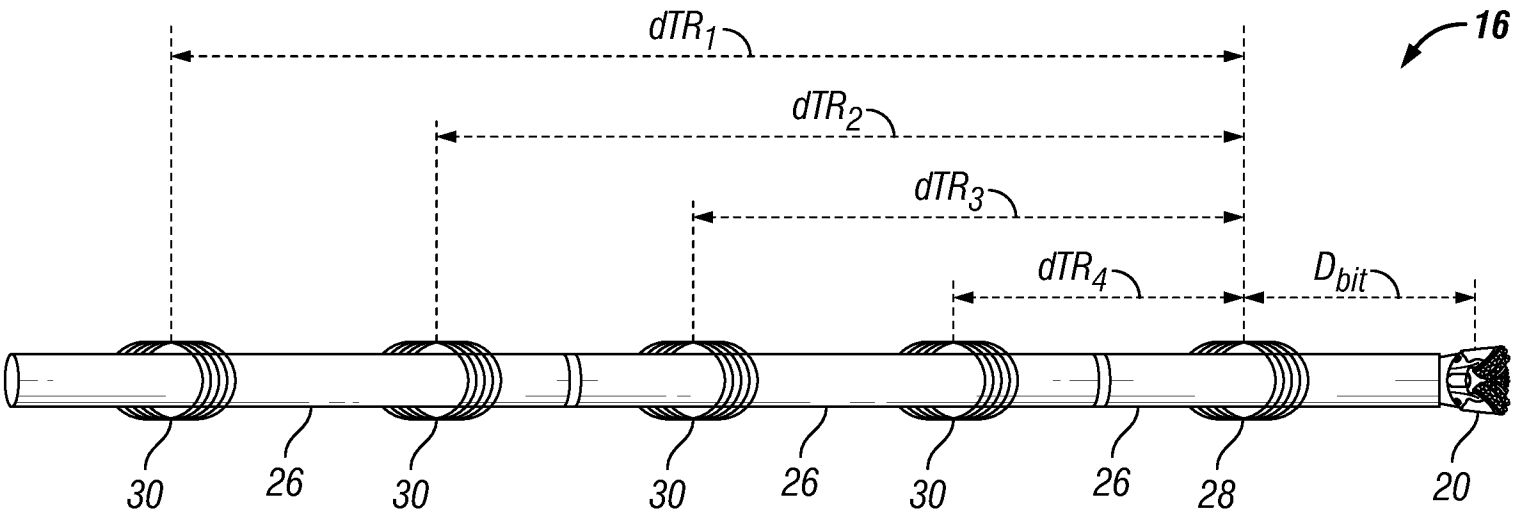
FIG. 9 illustrates another example of a modular electromagnetic ranging tool.

All the above receiver-transmitter spacing may be realized by placing four receivers 30 on BHA at distances $dTR_1$=86'~96', $dTR_2$=59'~69', $dTR_3$=32'~42', and $dTR_4$=14'~24' from transmitter coil 28 as shown in FIG. 9 to have a modular electromagnetic ranging tool 16 to work at multi frequencies. So to operate the tool at $R_f=1$ Ω·m (f=0.5~5 kHz), the pair of sensors of receiver-1 and receiver-4 with spacing $dTR_1$ and $dTR_4$ may be used. Similarly, the pair of $dTR_1$ and $dTR_3$ for operation at $R_f=10$ Ω·m, and the pair of $dTR_1$ and $dTR_2$ for operation at $R_f=100$ Ω·m may be used for ranging measurement. The number of the sensors and the spacing may be designed based on the operation frequencies and the formation resistivities where the tool needs to be operated.

Referring now to FIG. 9, another example of modular electromagnetic ranging tool 16 is shown. As illustrated, modular electromagnetic ranging tool 16 may comprise multiple modular sections 26 that may configure modular electromagnetic ranging tool 16 to comprise at least four receivers 30. Drill bit 20 may be disposed at a distal end of modular electromagnetic ranging tool 16. Additional receivers 30 may allow for different transmitter-receiver spacings $dTR_1$, $dTR_2$, $dTR_3$, $dTR_4$. The use of multiple receivers 30 at different distance from transmitter coil 28 may allow operational frequencies to be used in different subterranean formations 8. Different receivers 30 may operate within different subterranean formations 8, allowing a single configuration of modular electromagnetic ranging tool 16 to be effective through different subterranean formations 8 with different resistivities. The signals collected by receivers 30 may be used to determine the distance and direction to target wellbore 4.

Electromagnetic ranging system 2, as disclosed above, may offer features useful in determining the location of target wellbore 4. For example, electromagnetic ranging system 2 may comprise modular electromagnetic ranging tool 16 with a plurality of receivers 30 and transmitter coil 28, which may be arranged in different configurations for a larger ranger of detection as compared to radial gradient configurations. At least two receivers 30, separated along modular electromagnetic ranging tool 16, may be used in determining the location, including distance and direction, of target wellbore 4. Distance between receivers 30 may be selected based on the operational frequency and the formation resistivity. Inversion algorithms and/or gradient techniques may be used for ranging calculations.

In examples, electromagnetic ranging system 2 may allow use of multi-frequency operations for doing ranging measurements in areas with different formation resistivity. Frequencies may be pre-selected and/or selected during ranging operations. Multi-frequency operations may be employed by a plurality of receivers 30 and/or transmitter coils 32 properly spaced on modular electromagnetic ranging tool 16. Thus, based on the operational frequency, a pair of receivers 30 within the multi-frequency operation may be programmed to do ranging measurements. Additionally, electromagnetic ranging system 2 may be able to measure the resistivity of a plurality of subterranean formations 8 during drilling, and use the measured resistivity information to select between frequencies during drilling operations.

Other useful features of electromagnetic ranging system 2 may be modular sections 26, which may allow transmitter coil 28 and receivers 30 to be disposed adjacent drill bit 20, below a drill motor (not illustrated), and/or on either side of a tool disposed on modular electromagnetic ranging tool 16. Different modular sections 26 with different components may be prepared and attached, which may comprise the proper configuration and spacing between transmitter coil 28 and receivers 30. Electromagnetic ranging system 2 may operate in real-time as part of an integrated drilling system, which may provide multiple ranging measurements at a single depth and higher quality single measurements by utilizing multiple sensor data.

An electromagnetic ranging system for locating a target well may comprise a modular electromagnetic ranging tool. Wherein the modular electromagnetic ranging tool may comprise at least one transmitter coil, wherein operable to induce an electromagnetic field in a conductive member, and a receiver coil operable to measure at least one component of the electromagnetic field. The receivers coil and the at least one transmitter coil may be disposed on different modular sections of the modular electromagnetic ranging tool. An information handling system may be in signal communication with the modular electromagnetic ranging tool, wherein the information handling system may be operable to determine a relative location of the conductive member from at least measurements by the receiver coil and one or more parameters of the at least one transmitter coil. This electromagnetic ranging system may include any of the various features of the compositions, methods, and system disclosed herein, including one or more of the following features in any combination. The information handling system may be operable to adjust an operating frequency of the transmitter coil. The receiver coil may be operable at different frequencies. A spacing of the receiver coil from the at least one transmitter coil may be individually selected based on preselected operating frequencies. A drill bit may be coupled to a modular section on which the receiver coil may be disposed, wherein the at least one transmitter coil may be disposed on another modular section at an end opposite the drill bit. A drill bit may be coupled to the modular electromagnetic ranging system, wherein a modular section comprising the receiver coil may be disposed on an opposite side of the at least one transmitter coil from the drill bit. Three or more receiver coils may be disposed on an opposite side of the transmitter coil from a drill bit. A downhole tool may be disposed between the at least one transmitter coil and the receiver coil. The at least one transmitter coil may be a tilted coil and wherein the receiver coil is a tilted receiver coil or magnetometer receiver.

A method for electromagnetic ranging of a target wellbore may comprise disposing a modular electromagnetic ranging tool in a wellbore, transmitting an electromagnetic field to the target wellbore from at least one transmitter coil disposed on the modular electromagnetic ranging tool, and measuring at least one component of a secondary electromagnetic field from the target wellbore with at least one receiver coil disposed on the modular electromagnetic ranging tool. At least one transmitter coil and the at least one receiver coil may be disposed on different modular sections of the modular electromagnetic ranging tool. The method may further comprise determining a relative location of the target wellbore from at least measurements by the at least one receiver coil and one or more parameters of the at least one transmitter coil. This method may include any of the various features of the compositions, methods, and systems disclosed herein, including one or more of the following feature in any combination. Measuring a phase difference and/or amplitude ratio between a first module and a second module, wherein the measured phase difference and/or amplitude ratio may be used in determining the relative location of the conductive member. The electromagnetic ranging tool may be on a bottom hole assembly with a drill bit coupled to a distal end of the modular electromagnetic ranging tool. Selecting a frequency for operation of the at least one transmitter coil, wherein the at least one receiver coil may be at a spacing from the at least one transmitter coil for operation at the frequency. Selecting spacing of the at least one transmitter coil and the at least one receiver coil based on a frequency for operation of the at least one transmitter coil and assembling modular sections of the modular electromagnetic ranging tool to provide the modular electromagnetic ranging tool with the selected spacing. The selected spacing may be based on one or more of formation resistivities or operational frequencies of the electromagnetic ranging tool. The electromagnetic field may be transmitted at a first frequency, the method further comprising transmitting a second electromagnetic field from the at least one transmitter at a second frequency. Measuring at least one component of another secondary electromagnetic field induced by the second electromagnetic field using a second receiver coil at a different spacing from the at least one transmitter coil from the receiver coil. Selecting the at least one receiver coil for use in the determining the relative location from receiver coils disposed on the modular electromagnetic ranging tool, wherein the at least one receiver coil may be selected base on spacing from the at least one transmitter coil. At least one receiver coil determines the relative location of the target wellbore with a gradient measurement. Measuring formation resistivity and selecting a frequency for operation of the at least one transmitter coil based, at least in part, on the measured formatting resistivity. Disposing a downhole device between a modular section of the modular electromagnetic ranging tool and another modular section of the modular electromagnetic ranging tool. Adjusting one or more drilling parameters of the wellbore and continuing drilling of the wellbore.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. An electromagnetic ranging system comprising:

a modular electromagnetic ranging tool comprising:

at least one transmitter coil, wherein operable to transmit an electromagnetic field that induces an eddy current in a conductive member disposed in a target wellbore; and a receiver coil operable to measure at least one component of a secondary electromagnetic field generated from the eddy current, wherein the receivers coil and the at least one transmitter coil are disposed on different modular sections of the modular electromagnetic ranging tool; and an information handling system in signal communication with the modular electromagnetic ranging tool, wherein the information handling system is operable to determine a relative location of the conductive member in the target wellbore from at least measurements by the receiver coil and one or more parameters of the at least one transmitter coil.

2. The electromagnetic ranging system of claim 1, wherein the information handling system is operable to adjust an operating frequency of the transmitter coil.

3. The electromagnetic ranging system of claim 2, wherein the receiver coil is operable at different frequencies.

4. The electromagnetic ranging system of claim 1, wherein a spacing of the receiver coil from the at least one transmitter coil is individually selected based on preselected operating frequencies.

5. The electromagnetic ranging tool of claim 1, wherein a drill bit is coupled to a modular section on which the receiver coil is disposed, wherein the at least one transmitter coil is disposed on another modular section at an end opposite the drill bit.

6. The electromagnetic ranging tool of claim 1, wherein a drill bit is coupled to the modular electromagnetic ranging system, wherein a modular section comprising the receiver coil is disposed on an opposite side of the at least one transmitter coil from the drill bit.

7. The electromagnetic ranging tool of claim 1, wherein three or more receiver coils are disposed on an opposite side of the transmitter coil from a drill bit.

8. The electromagnetic ranging tool of claim 1, wherein a downhole tool is disposed between the at least one transmitter coil and the receiver coil.

9. The electromagnetic ranging tool of claim 1, wherein the at least one transmitter coil is a tilted coil and wherein the receiver coil is a tilted receiver coil or magnetometer receiver.

10. A method for electromagnetic ranging of a target wellbore, comprising:

disposing a modular electromagnetic ranging tool in a wellbore;

transmitting an electromagnetic field to the target wellbore from at least one transmitter coil disposed on the modular electromagnetic ranging tool to induce an eddy current in the target wellbore;

measuring at least one component of a secondary electromagnetic field generated by the eddy current from the target wellbore with at least one receiver coil disposed on the modular electromagnetic ranging tool, wherein the at least one transmitter coil and the at least one receiver coil are disposed on different modular sections of the modular electromagnetic ranging tool; and determining a relative location of the target wellbore from at least measurements by the at least one receiver coil and one or more parameters of the at least one transmitter coil.

11. The method of claim 10, further comprising measuring a phase difference or amplitude ratio between a first module and a second module, wherein the measured phase difference or amplitude ratio is used in determining the relative location of the conductive member.

12. The method of claim 10, wherein the electromagnetic ranging tool is on a bottom hole assembly with a drill bit coupled to a distal end of the modular electromagnetic ranging tool.

13. The method of claim 10, further comprising selecting a frequency for operation of the at least one transmitter coil, wherein the at least one receiver coil is at a spacing from the at least one transmitter coil for operation at the frequency.

14. The method of claim 10, further comprising:

selecting spacing of the at least one transmitter coil and the at least one receiver coil based on a frequency for operation of the at least one transmitter coil; and assembling modular sections of the modular electromagnetic ranging tool to provide the modular electromagnetic ranging tool with the selected spacing.

15. The method of claim 14, wherein the selected spacing is based on one or more of formation resistivities or operational frequencies of the electromagnetic ranging tool.

16. The method of claim 10, wherein the electromagnetic field is transmitted at a first frequency, the method further comprising transmitting a second electromagnetic field from the at least one transmitter at a second frequency.

17. The method of claim 16, further comprising measuring at least one component of a third electromagnetic field induced by the secondary electromagnetic field using a second receiver coil at a different spacing from the at least one transmitter coil from the receiver coil.

18. The method of claim 10, further comprising selecting the at least one receiver coil for use in the determining the relative location from receiver coils disposed on the modular electromagnetic ranging tool, wherein the at least one receiver coil is selected based on spacing from the at least one transmitter coil.

19. The method of claim 18, wherein the at least one receiver coil determines the relative location of the target wellbore with a gradient measurement.

20. The method of claim 10 measuring formation resistivity and selecting a frequency for operation of the at least one transmitter coil based, at least in part, on the measured formatting resistivity.

21. The method of claim 10, further comprising disposing a downhole device between a modular section of the modular electromagnetic ranging tool and another modular section of the modular electromagnetic ranging tool.

22. The method of claim 10, further comprise adjusting one or more drilling parameters of the wellbore and continuing drilling of the wellbore.

23. A method for electromagnetic ranging of a target wellbore, comprising:

disposing a modular electromagnetic ranging tool in a wellbore;

transmitting an electromagnetic field to the target wellbore from at least one transmitter coil disposed on the modular electromagnetic ranging tool to induce an eddy current in the target wellbore;

measuring at least one component of a secondary electromagnetic field generated by the eddy current from the target wellbore with at least one receiver coil disposed on the modular electromagnetic ranging tool, wherein the at least one transmitter coil and the at least one receiver coil are disposed on different modular sections of the modular electromagnetic ranging tool;

measuring a phase difference or amplitude ratio between a first module and a second module, wherein the measured phase difference or amplitude ratio is used in determining the relative location of the conductive member; and determining a relative location of the target wellbore from at least measurements by the at least one receiver coil and one or more parameters of the at least one transmitter coil.

24. A method for electromagnetic ranging of a target wellbore, comprising:

disposing a modular electromagnetic ranging tool in a wellbore;

transmitting an electromagnetic field to the target wellbore from at least one transmitter coil disposed on the modular electromagnetic ranging tool to induce an eddy current in the target wellbore;

measuring at least one component of a secondary electromagnetic field generated by the eddy current from the target wellbore with at least one receiver coil disposed on the modular electromagnetic ranging tool, wherein the at least one transmitter coil and the at least one receiver coil are disposed on different modular sections of the modular electromagnetic ranging tool;

determining a relative location of the target wellbore from at least measurements by the at least one receiver coil and one or more parameters of the at least one transmitter coil; and selecting the at least one receiver coil for use in the determining the relative location from receiver coils disposed on the modular electromagnetic ranging tool, wherein the at least one receiver coil is selected based on spacing from the at least one transmitter coil.

25. A method for electromagnetic ranging of a target wellbore, comprising:

disposing a modular electromagnetic ranging tool in a wellbore;

transmitting an electromagnetic field to the target wellbore from at least one transmitter coil disposed on the modular electromagnetic ranging tool to induce an eddy current in the target wellbore;

measuring at least one component of a secondary electromagnetic field generated by the eddy current from the target wellbore with at least one receiver coil disposed on the modular electromagnetic ranging tool, wherein the at least one transmitter coil and the at least one receiver coil are disposed on different modular sections of the modular electromagnetic ranging tool;

determining a relative location of the target wellbore from at least measurements by the at least one receiver coil and one or more parameters of the at least one transmitter coil; and selecting the at least one receiver coil for use in the determining the relative location from receiver coils disposed on the modular electromagnetic ranging tool, wherein the at least one receiver coil is selected based on spacing from the at least one transmitter coil, wherein the at least one receiver coil determines the relative location of the target wellbore with a gradient measurement.

* * * * *